US008210140B2

(12) United States Patent
Kuhl et al.

(10) Patent No.: US 8,210,140 B2
(45) Date of Patent: Jul. 3, 2012

(54) HYDRAULIC UNIT FOR A CYLINDER HEAD OF AN INTERNAL COMBUSTION ENGINE WITH HYDRAULICALLY VARIABLE GAS-EXCHANGE VALVE TRAIN

(75) Inventors: Mario Kuhl, Herzogenaurach (DE); Andreas Eichenberg, Chemnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 284 days.

(21) Appl. No.: 12/718,066

(22) Filed: Mar. 5, 2010

(65) Prior Publication Data

US 2010/0224152 A1 Sep. 9, 2010

(30) Foreign Application Priority Data

Mar. 5, 2009 (DE) ..... 10 2009 011 982

(51) Int. Cl.
*F01L 9/02* (2006.01)

(52) U.S. Cl. ..... 123/90.12; 123/90.13; 92/163; 137/625; 277/591

(58) Field of Classification Search ..... 123/90.12, 123/90.13; 137/625; 92/163; 277/591
See application file for complete search history.

(56) References Cited

U.S. PATENT DOCUMENTS

| | | | | |
|---|---|---|---|---|
| 7,441,525 | B2 * | 10/2008 | Jessberger et al. | 123/90.37 |
| 2002/0121252 | A1 | 9/2002 | Payne et al. | |

FOREIGN PATENT DOCUMENTS

| | | |
|---|---|---|
| DE | 3604233 | 8/1987 |
| DE | 102006008676 | 8/2007 |
| DE | 102007054376 | 5/2009 |
| EP | 1243761 | 9/2002 |
| EP | 1353056 | 10/2003 |
| EP | 2060754 | 5/2009 |

* cited by examiner

*Primary Examiner* — Ching Chang
(74) *Attorney, Agent, or Firm* — Volpe and Koenig, P.C.

(57) ABSTRACT

A hydraulic unit (5) is provided for a cylinder head (2) of an internal combustion engine with a hydraulically variable gas-exchange valve train (1). In the hydraulic unit, a high-pressure chamber (11), a medium-pressure chamber (12), and a low-pressure chamber (16) used as the hydraulic medium reservoir are formed. The low-pressure chamber communicates via a throttle opening (17, 17', 17", 17'") with the medium-pressure chamber, and the throttle opening extends through a housing seal (23) produced as a separate component.

7 Claims, 6 Drawing Sheets

HYDRAULIC UNIT FOR A CYLINDER HEAD OF AN INTERNAL COMBUSTION ENGINE WITH HYDRAULICALLY VARIABLE GAS-EXCHANGE VALVE TRAIN

CROSS-REFERENCE TO RELATED APPLICATIONS

This application claims the benefit of German Patent Application No. 102009011982.5, filed Mar. 5, 2009, which is incorporated herein by reference as if fully set forth.

FIELD OF THE INVENTION

The invention relates to a hydraulic unit for a cylinder head of an internal combustion engine with a hydraulically variable gas-exchange valve train.

The hydraulic unit comprises:

at least one drive-side master unit, at least one driven-side slave unit, at least one controllable hydraulic valve, at least one medium-pressure chamber, at least one high-pressure chamber that is arranged in the sense of transmission between the associated master unit and the associated slave unit and that can be connected by the associated hydraulic valve to the associated medium-pressure chamber, at least one low-pressure chamber that is used as a hydraulic medium reservoir and that is connected via a throttle opening to the associated medium-pressure chamber, and a hydraulic housing with a bottom part of the housing, a middle part of the housing, and a top part of the housing, wherein the master unit, the slave unit, the hydraulic valve, and the medium-pressure chamber run in the bottom part of the housing, the low-pressure chamber is constructed in the top part of the housing, and the throttle opening is part of a hydraulic medium channel passing through the middle part of the housing.

BACKGROUND

Such a hydraulic unit is derived from the not previously published DE 10 2007 054 376 A1. In the case of the hydraulic unit proposed in that document, all of the essential components required for the hydraulically variable transmission of cam lobes to the gas-exchange valves and the pressure chambers are assembled in a common hydraulic housing in a sandwiched construction. The bottom part of the housing has a very compact structural configuration and the middle part of the housing involves an essentially flat plate, so that each of the medium-pressure chambers is limited to a correspondingly small volume.

As explained in the cited publication, however, a small-volume medium-pressure chamber can be problematic during the starting procedure of the internal combustion engine, especially if it involves a starting procedure at low outside temperatures and when the internal combustion engine has been at a standstill for a long time. This is based on the fact that, during the starting procedure, the hydraulic medium supply system of the internal combustion engine is still feeding an insufficient flow of hydraulic medium into the medium-pressure chamber and only the hydraulic medium volume that remains in the medium-pressure chamber and that also contracts at low temperatures is an insufficient amount for completely refilling an expanding high-pressure chamber. This problem applies to greater degrees for starting procedures repeated within a short time sequence, because in this case, the hydraulic medium consumption from the medium-pressure chamber can be larger than the volume fed back from the hydraulic medium supply system of the internal combustion engine. Such multiple starting procedures are typical, for example, for taxis at taxi stands.

For solving these problems, in the cited publication it is proposed to form in the top part of the housing a low-pressure chamber used as a hydraulic medium reservoir that is connected to the medium-pressure chamber via a throttle opening in the middle part of the housing. With the help of the low-pressure chamber, first, the hydraulic medium reservoir required during the starting procedure of the internal combustion engine expands for the medium-pressure chamber and consequently for the high-pressure chamber and, second, the risk of suction of gas bubbles is largely eliminated. The latter is realized by the middle part of the housing that separates the low-pressure chamber from the medium-pressure chamber, so that, during the standstill phase of the internal combustion engine and with this cooling and consequently contracting hydraulic medium, the formation of gas bubbles in the medium-pressure chamber is prevented by the feeding of hydraulic medium from the low-pressure chamber.

One disadvantage, however, is the expense for producing such a throttle opening in the form of the very small diameter of a stepped borehole equal to only a few tenths of a millimeter through the middle part of the housing. For example, in the case of a borehole produced with cutting, high tool wear or frequent tool failure is to be taken into account, while production by laser beam leads to undesired high form and cross-sectional deviations from the desired geometry of the throttle opening.

SUMMARY

Therefore, the present invention is based on the objective of refining a hydraulic unit of the type named above so that the throttle opening between the medium-pressure chamber and the low-pressure chamber can be produced with low expense and simultaneously as precisely as possible.

This objective is met by the hydraulic unit according to the invention, while advantageous refinements and constructions of the invention can be taken from following description and claims. Consequently it is provided that the throttle opening extends in a housing seal that is arranged as a separate component either between the bottom part of the housing or the op part of the housing on one side and the middle part of the housing on the other side, wherein the section of the hydraulic medium channel passing through the middle part of the housing has a low-throttle construction. The displacement of the throttle opening from the middle part of the housing to the housing seal leads to a significantly lower production expense, because the throttle opening can be produced, in particular, by stamping a one-layer or multiple-layer metal seal, as it is often used as such in the cylinder head region of internal combustion engines, and can be produced precisely and economically. Simultaneously, the middle part of the housing can be produced significantly more economically due to its now falling throttling effect.

In one refinement of the invention, the housing seal should be constructed as a flat seal and should have a tubular lobe that limits the throttling opening like a kind of nozzle. The nozzle-like geometry of the throttle opening leads to a pronounced viscosity dependency of the hydraulic medium volume flow such that the volume flow to be throttled at low temperatures/high-viscosity hydraulic medium is significantly smaller than at high temperatures/low-viscosity hydraulic medium. This throttling characteristic is especially advantageous when the top part of the housing is provided with an overflow opening into the cylinder head. This is used not only for ventilating the low-pressure chamber, but also for cooling the hydraulic unit, in that heated hydraulic medium escape via the low-pressure chamber into the cylinder head and can be consequently fed back into the cooled hydraulic medium circuit of the internal combustion engine. Here, the viscosity-dependent throttling effect causes a tailored flushing of the hydraulic unit that is ideally formed such that, for hot hydraulic medium, the greatest possible flushing is realized and for cold hydraulic medium, no flushing of the hydraulic unit is realized.

Preferably, the housing seal is arranged between the bottom part of the housing and the middle part of the housing and the lobe extends into a passage borehole in the middle part of the housing. Through the lobe oriented in this way, gas bubbles in the medium-pressure chamber can escape into the low-pressure chamber in the best possible way.

In addition, another housing seal could be provided that is similarly constructed as a separate component and that is arranged between the bottom part of the housing and the top part of the housing on the side of the middle part of the housing facing away from the housing seal. Consequently, the hydraulic unit is sealed from the surroundings by separate housing seals in the region of both joints on the middle part of the housing.

These housing seals can have different constructions from each other, on one hand to the extent that the section of the hydraulic medium channel passing through the additional housing seal has a low-throttle construction. In other words, in this case the function of the additional housing seal is limited to sealing the hydraulic unit from the surroundings.

On the other hand, however, the housing seal and the additional housing seal could also involve identical parts. Through corresponding effects on piece numbers, further reduced production costs are to be expected. Due to the resulting double throttling effect, there is also the possibility to form the throttle openings with relative large cross section in support of further improved manufacturability.

BRIEF DESCRIPTION OF THE SEVERAL VIEWS OF THE DRAWINGS

Additional features of the invention can be taken from the following description and from the drawings in which embodiments of the invention are shown. If not otherwise mentioned, features or components that are identical or that have identical functions are provided with identical reference symbols. Shown are.

DETAILED DESCRIPTION OF THE PREFERRED EMBODIMENTS

Figure 1:
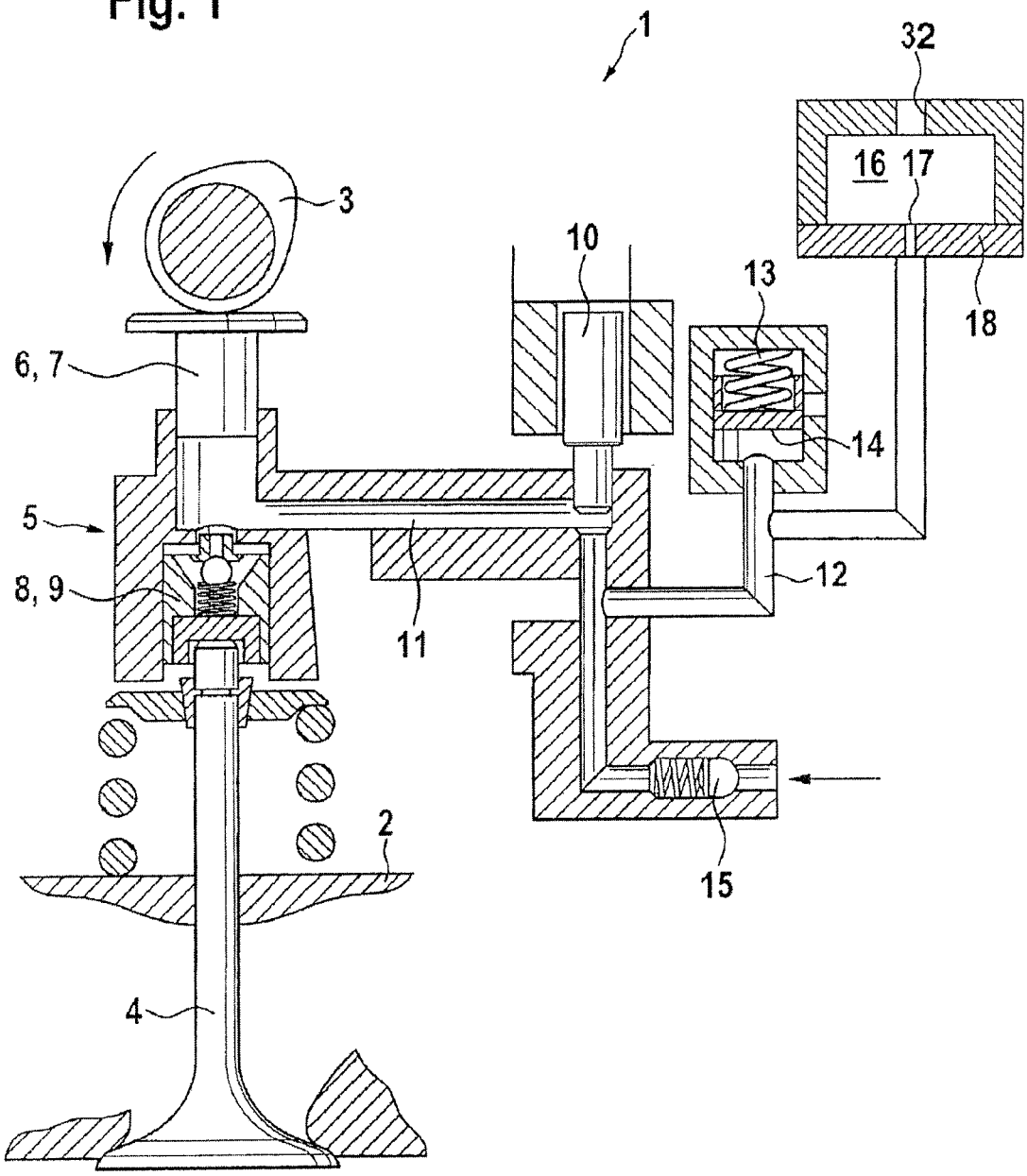
FIG. 1 is a schematic diagram of a hydraulically variable gas-exchange valve train.

In FIG. 1, the principle configuration of a hydraulically variable gas-exchange valve train 1 is disclosed schematically. Shown is a cutout that is essential for understanding the invention in a cylinder head 2 of an internal combustion engine with a cam 3 of a camshaft and a gas-exchange valve 4 that is spring loaded in the closing direction. The variability of the gas-exchange valve train 1 is generated by a hydraulic unit 5 that is arranged between the cam 3 and the gas-exchange valve 4 and that comprises the following components:

- a drive-side master unit 6, here in the form of a pump tappet 7 driven by the cam 3,
- a driven-side slave unit 8, here in the form of a slave piston 9 directly activating the gas-exchange valve 4,
- a controllable hydraulic valve 10, here in the form of an electromagnetic 2-2-port switch valve,
- a high-pressure chamber 11 running between the master unit 6 and the slave unit 8, wherein, for an opened hydraulic valve 10, hydraulic medium can flow out from this high-pressure chamber into a medium-pressure chamber 12,
- a pressure accumulator 13 connected to the medium-pressure chamber 12 with a spring-loaded compensation piston 14,
- a non-return valve 15 opening in the direction of the medium-pressure chamber 12, wherein, by this non-return valve, the hydraulic unit 5 is connected to the hydraulic medium circuit of the internal combustion engine,
- and a low-pressure chamber 16 that is used as a hydraulic medium reservoir and that is connected to the medium-pressure chamber 12 via a throttle opening 17 in a separating wall 18 separating the low-pressure chamber 16 from the medium-pressure chamber 12.

The known function of the hydraulic gas-exchange valve 1 can be combined to the extent that the high-pressure chamber 11 acts as a hydraulic link between the master unit 6 and the slave unit 8, wherein—disregarding leakage—the hydraulic volume forced by the pump tappet 7 proportional to the stroke of the cam 3 is split as a function of the opening time and the opening period of the hydraulic valve 10 into a first sub-volume loading the slave piston 9 and into a second sub-volume flowing into the medium-pressure chamber 12 including the pressure accumulator 13. In this way, the stroke transfer of the pump tappet 7 to the slave piston 9 and consequently not only the control times, but also the stroke height of the gas-exchange valve 4 are fully variable.

Figure 2:
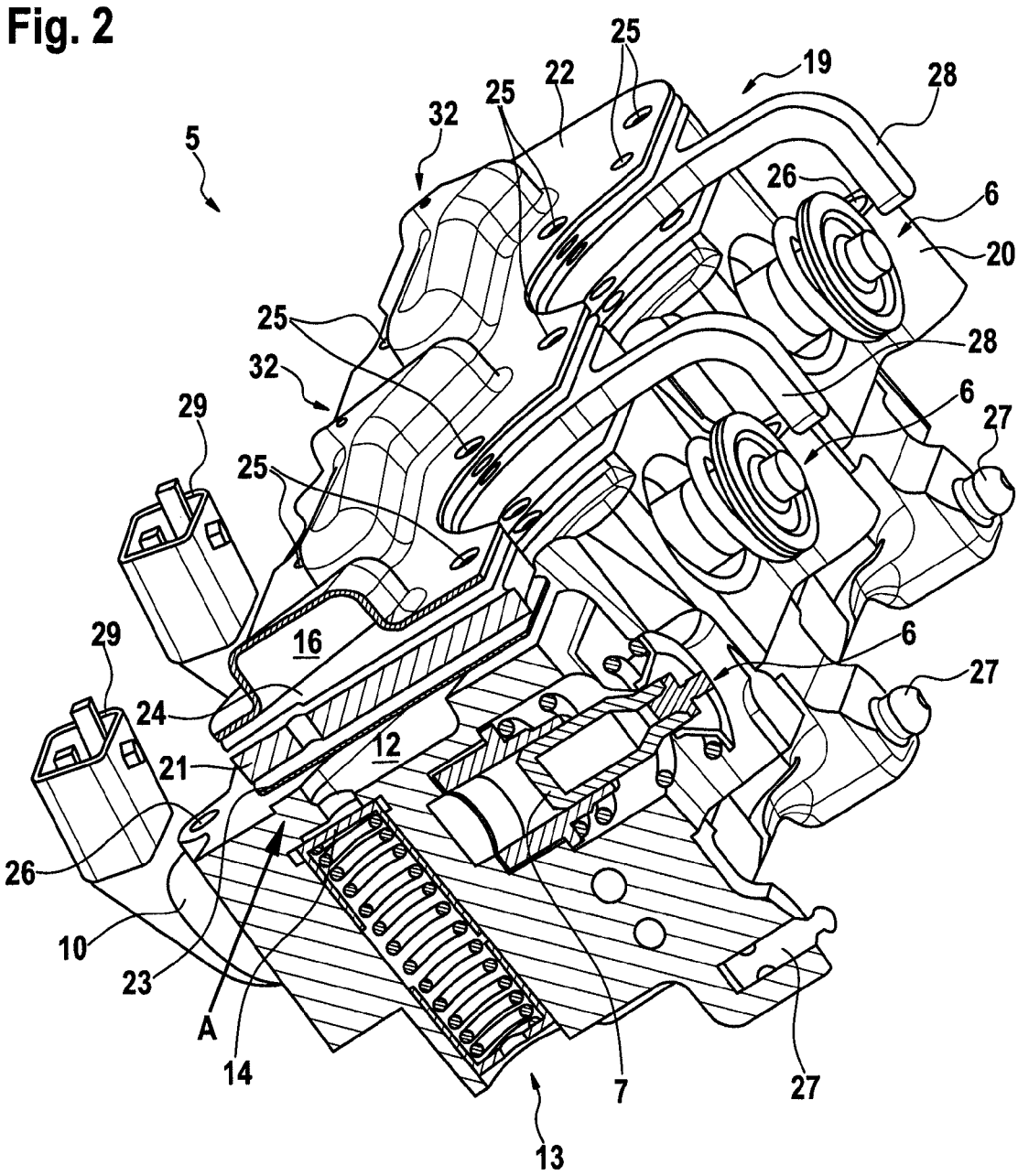
FIG. 2 is a perspective and partially exploded section view of a hydraulic unit.

The hydraulic unit shown in a transverse cross section in FIG. 2 for a 4-cylinder in-line engine has, as an additional essential component, a common hydraulic housing 19, so that the hydraulic unit 5 can be mounted as a preassembled component optionally already filled with hydraulic medium in the cylinder head 2 of the internal combustion engine. The hydraulic housing 19 in a sandwich configuration comprising a bottom part 20 of the housing, a middle part 21 of the housing, and a top part 22 of the housing. For sealing the joint between the bottom part 20 of the housing and the middle part 21 of the housing, there is a housing seal 23, and for sealing the joint between the middle part 21 of the housing and the top part 22 of the housing there is an additional housing seal 24. Both seals 23, 24 involve separate components in the form of one-layer metal seals. The housing parts 20, 21, 22 are screwed to each other in a hydraulically sealed manner at various screw connection points 25. For fixing the entire hydraulic unit 5 in the cylinder head 2 of the internal combustion engine, the bottom part 20 of the housing has separate screw connection points 26.

The four master units 6 in the bottom part 20 of the housing each comprise the pump tappet 7 that is spring loaded in the return-stroke direction and that is driven by a cam-activated cam follower not shown here. The pivoting support of the cam follower is performed by support elements 27 that are likewise held in the bottom part 20 of the housing. Brackets 28 going out from the middle part 21 of the housing are used as securing devices for the cam follower for a hydraulic unit 5 not mounted in the cylinder head 2. This is further constructed so that each of the master units 6 interacts with two slave units 8 (see FIG. 1) in the bottom part 20 of the housing. In other words, for each pair of gas-exchange valves 4 with identical function, i.e., intake valves or exhaust valves of a cylinder of the internal combustion engine, only one cam 3 and one master unit 6 are needed, wherein the hydraulic volume forced from the pump tappet 7 simultaneously loads both slave units 8.

On the side of the hydraulic unit 5 lying opposite the master units 6, the hydraulic valves 10 allocated to each master unit 6 and the two slave units 8 with electrical connection plugs 29 are to be seen. The hydraulic valves 10 connecting in the current-less state the medium-pressure chamber 12 to the high-pressure chamber 11 (see FIG. 1) are fixed in a known manner that is not shown here in more detail in valve holders in the bottom part 20 of the housing. The pressure accumulator 13 connected to the medium-pressure chamber 12 can also be seen.

The low-pressure chambers 16 each used as a hydraulic medium reservoir for the associated medium-pressure chamber 12 are formed by bulges in the top part 22 of the housing, wherein this top part is produced in a deep-drawing method from a steel plate. As clearly emerges from FIG. 3 as an enlarged view A, the low-pressure chamber 16 and the medium-pressure chamber 12 are connected to each other by a hydraulic medium channel that extends through the housing seals 23, 24 and the middle part 21 of the housing. According to FIG. 1, the housing seal 23 placed between the bottom part 20 of the housing and the middle part 21 of the housing with a stamped throttle opening 17' that has a diameter of approximately 0.4 mm is used as the separating wall 18. The other housing seal 24 between the middle part 21 of the housing and the top part 22 of the housing differs from the housing seal 23 in that its passage 30 has a multiple of the cross section of the throttle opening 17' just like the passage borehole 31 in the middle part 21 of the housing. The passage 30 and the passage borehole 31 to be easily produced thus represent low-throttle sections of the hydraulic medium channel.

Figure 3:
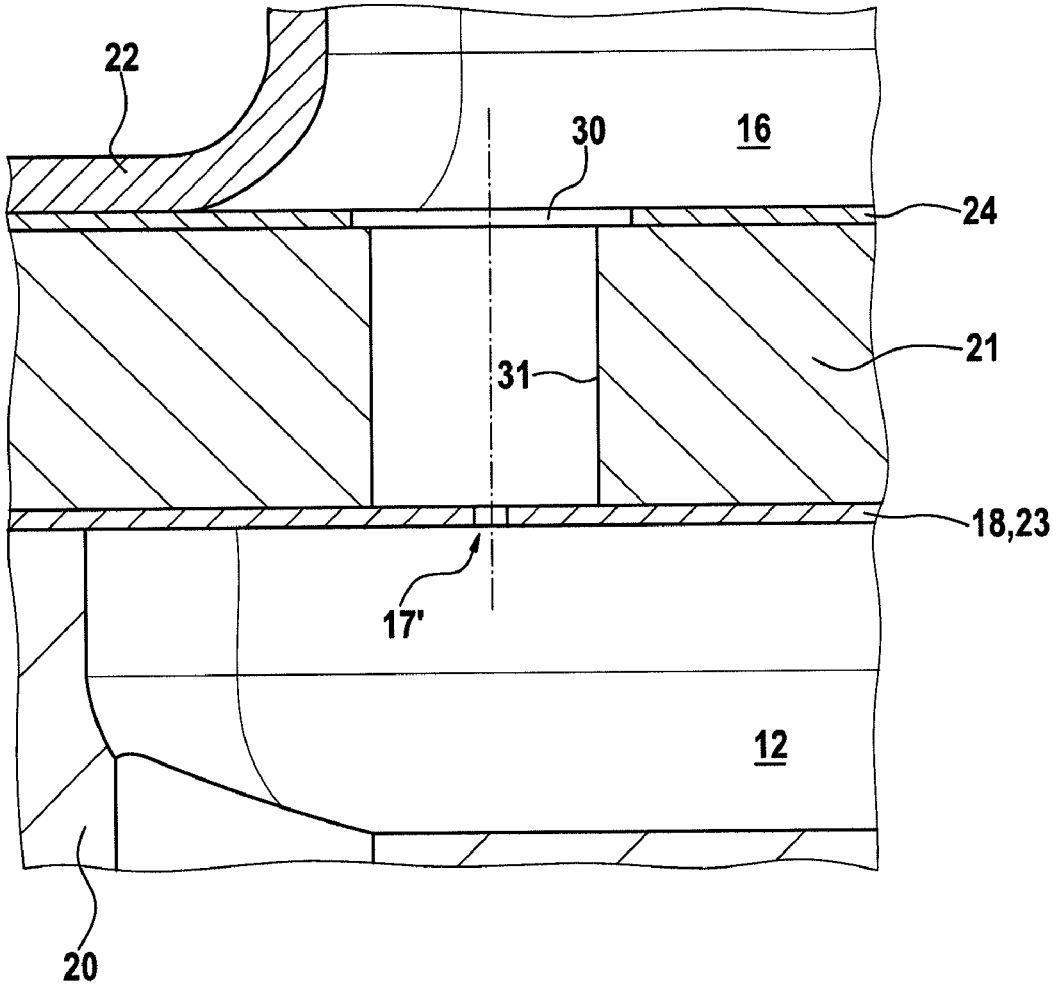
FIG. 3 is a view A according to FIG. 2 with two housing seals that are different from each other, wherein the throttle opening has a screen-like construction.
Figure 4:
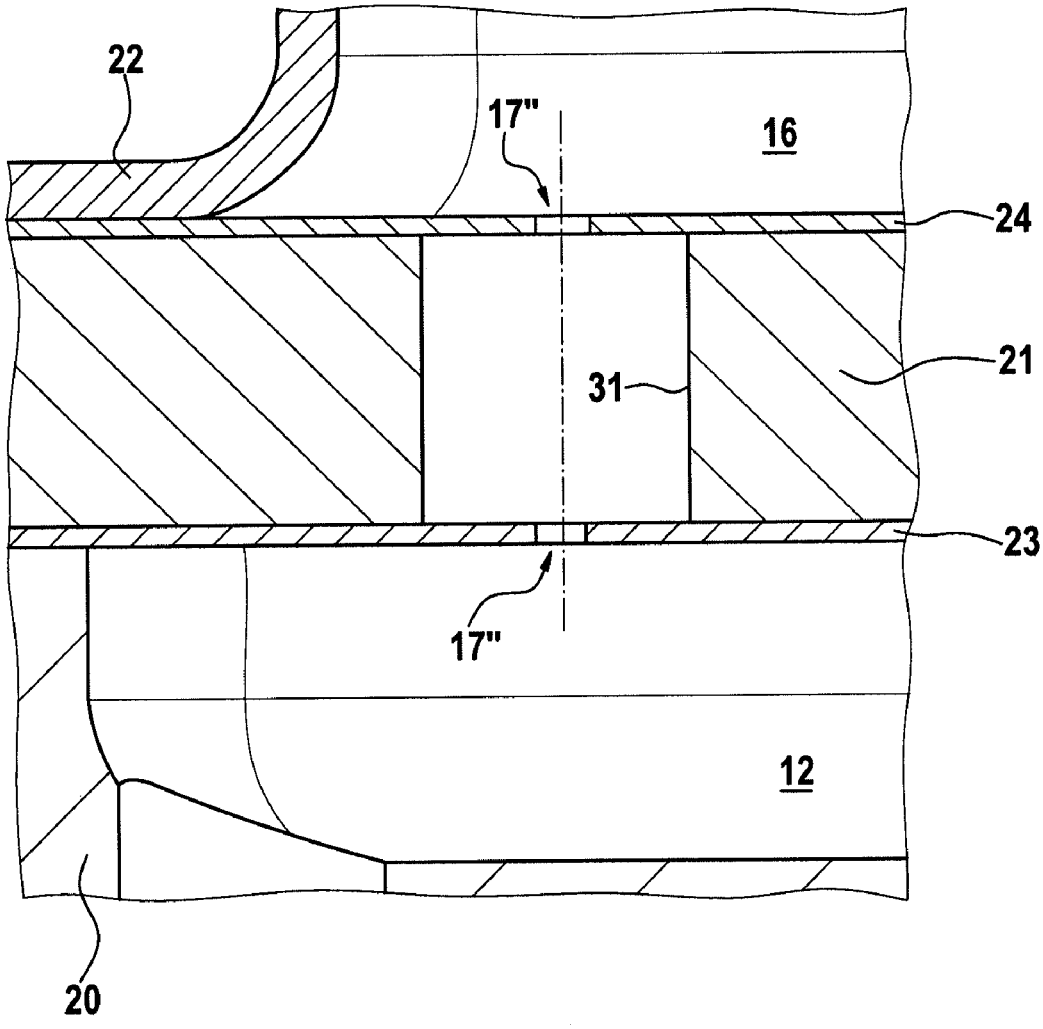
FIG. 4 is the view A according to FIG. 2 with two identical housing seals, wherein the throttle openings have a screen-like construction.

A construction of the housing seals that is an alternative to FIG. 3 is shown in FIG. 4. The housing seal 23 and the additional housing seal 24 are formed in this case as identical parts, so that the hydraulic medium channel passing through the middle part 21 of the housing and connecting the low-pressure chamber 16 to the medium-pressure chamber 12 has two throttling sections. Here, in order to achieve an identical throttling effect as in the embodiment according to FIG. 3, the diameter of the similarly stamped throttle openings 17" clearly equals more than 0.4 mm. The low-throttle passage borehole 31 in the middle part 21 of the housing is unchanged relative to the embodiment noted above.

Figure 5:
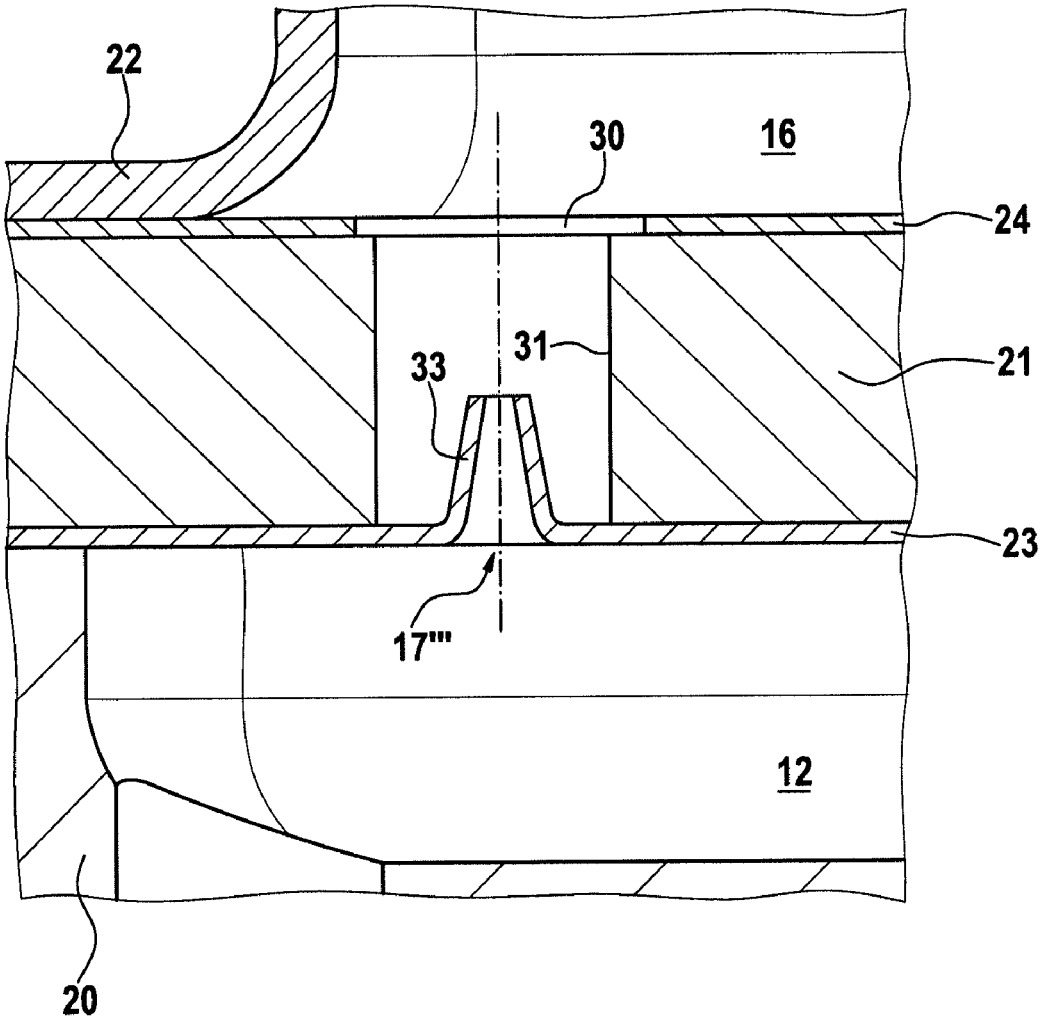
FIG. 5 is the view A according to FIG. 2 with two housing seals, wherein the throttle opening has a nozzle-like construction and the passage into the additional housing seal has a throttling construction.
Figure 6:
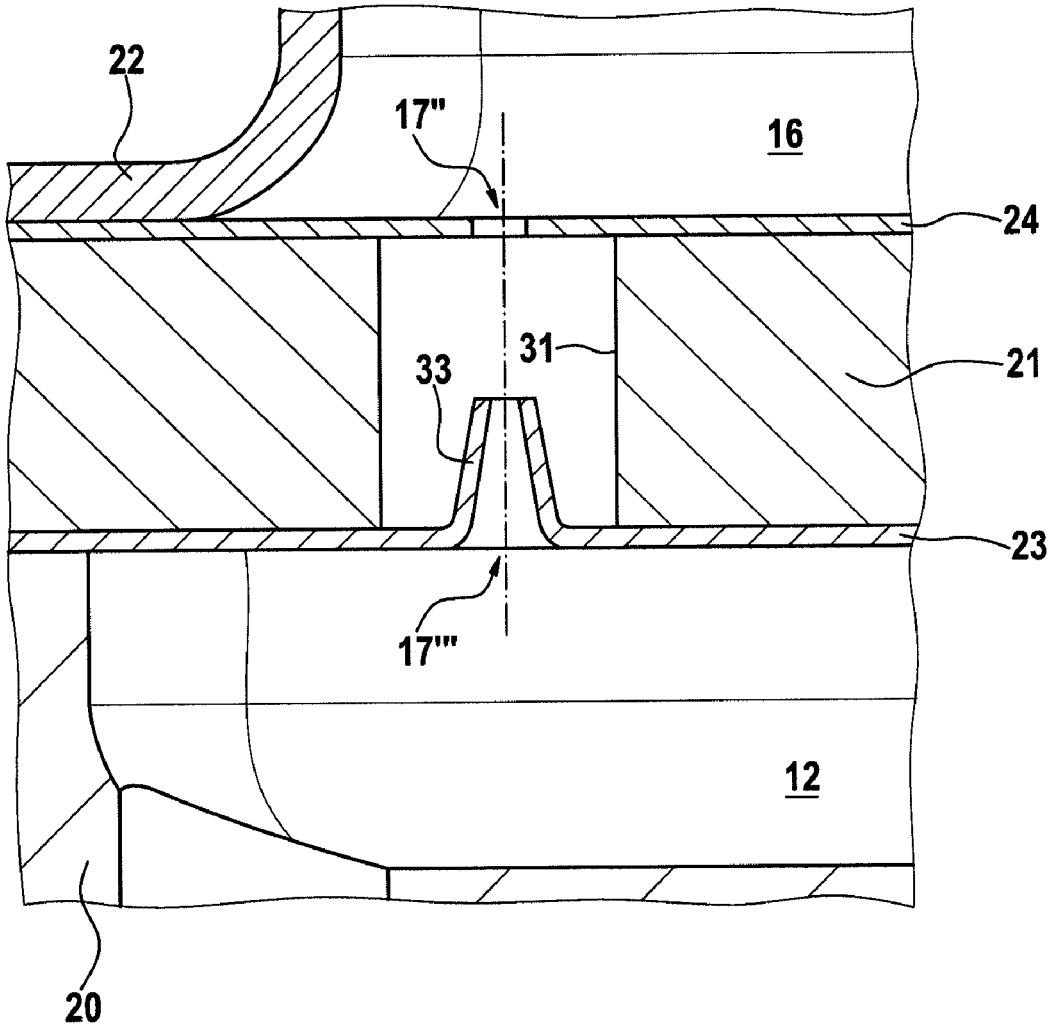
FIG. 6 is the view A according to FIG. 2 with two housing seals, wherein the throttle opening has a nozzle-like construction and the passage into the additional housing seal has a throttling construction.

In FIGS. 5 and 6, additional constructions of the housing seals 23 and 24 according to the invention are shown. In contrast to the merely stamped throttle openings 17', 17" whose length corresponds to the relatively small material thickness of the housing seals 23 and 24 and whose throttling characteristics are consequently similar to those of a viscosity-independent screen, the throttle opening 17''' is defined by a tubular lobe 33 of the housing seal 23. The lobe 33 produced in a deep-drawing step and extending with a multiple of the material thickness of the housing seal 23 into the passage borehole 31 has the effect that the throttle opening 17''' assumes the geometry of a viscosity-dependent nozzle supporting a here laminar flow. The constructions shown in FIGS. 5 and 6 differ merely in that the additional housing seal 24 has either the low-throttle passage 30 according to FIG. 3 or the screen-like throttle opening 17" connected in series with the throttle opening 17''' according to FIG. 4.

Although only one hydraulic medium channel with throttle opening 17' is shown in FIGS. 2 and 3, each medium-pressure chamber 12 can also be connected by two or more such hydraulic medium channels to the associated low-pressure chamber 16. Likewise it is conceivable to allocate two or more separate low-pressure chambers 16 to each medium-pressure chamber 12. This applies in a corresponding way also for the alternative constructions according to FIGS. 4 to 6.

As can be seen in FIGS. 1 and 2, gas bubbles that reach into the low-pressure chamber 16 via the throttle opening 17 from the medium-pressure chamber 12 are deposited during the operation of the internal combustion engine into the interior of the cylinder head 2 by a vent opening 32 extending in the top part 22 of the housing and opening into the cylinder head 2. This also relates to excess hydraulic medium, wherein the vent opening 32 is then used as an overflow.

LIST OF REFERENCE SYMBOLS

1 Gas-exchange valve train
2 Cylinder head
3 Cam
4 Gas-exchange valve
5 Hydraulic unit
6 Master unit
7 Pump tappet
8 Slave unit
9 Slave piston
10 Hydraulic valve
11 High-pressure chamber
12 Medium-pressure chamber
13 Pressure accumulator
14 Compensation piston
15 Non-return valve
16 Low-pressure chamber
17 Throttle opening
18 Separating wall
19 Hydraulic housing
20 Bottom part of housing
21 Middle part of housing
22 Top part of housing
23 Housing seal
24 Additional housing seal
25 Screw connection point
26 Screw connection point
27 Support element
28 Bracket
29 Connection plug of the hydraulic valve
30 Passage into the additional housing seal
31 Passage borehole in the middle part of the housing
32 Vent opening
33 Lobe

The invention claimed is:

1. The hydraulic unit for a cylinder head of an internal combustion engine with a hydraulically variable gas-exchange valve train, comprising at least one drive-side master unit, at least one driven-side slave unit, at least one controllable hydraulic valve, at least one medium-pressure chamber, at least one high-pressure chamber that is arranged in a transmission sense between the associated master unit and the associated slave unit and that can be connected by the associated hydraulic valve to the associated medium-pressure chamber, at least one low-pressure chamber that is used as a hydraulic medium reservoir and that is connected via a throttle opening to the associated medium-pressure chamber, a hydraulic housing with a bottom part of the housing, a middle part of the housing, and a top part of the housing, wherein the master unit, the slave unit, the high-pressure chamber, the hydraulic valve, the medium-pressure chamber extends in the bottom part of the housing, the low-pressure chamber is constructed in the top part of the housing, and the throttle opening is part of a hydraulic medium channel passing through the middle part of the housing, and the throttle opening extends in a housing seal that is arranged as a separate component either between the bottom part of the housing or the top part of the housing on one side and the middle part of the housing on the other side, and the section of the hydraulic medium channel passing through the middle part of the housing has a low-throttle construction.

2. The hydraulic unit according to claim 1, wherein the housing seal is constructed as a flat seal and has a tubular lobe that limits the throttle opening with a nozzle-type form.

3. The hydraulic unit according to claim 2, wherein the housing seal is arranged between the bottom part of the housing and the middle part of the housing, and the lobe extends into a passage borehole in the middle part of the housing.

4. The hydraulic unit according to claim 1, wherein an additional housing seal is provided that is arranged as a separate component between the bottom part of the housing and the top part of the housing on a side of the middle part of the housing facing away from the housing seal.

5. The hydraulic unit according to claim 4, wherein the housing seal and the additional housing seal have constructions that are different from each other, and the section of the hydraulic medium channel passing through the additional housing seal has a lower-throttle construction than the housing seal.

6. The hydraulic unit according to claim 4, wherein the housing seal and the additional housing seal are identical parts.

7. The hydraulic unit according to claim 1, wherein the housing seal comprises a one-layer or multiple-layer metal seal.

* * * * *